United States Patent [19]

McDermott

[11] Patent Number: 5,011,540

[45] Date of Patent: Apr. 30, 1991

[54] METHOD AND APPARATUS FOR CLEANING A GAS TURBINE ENGINE

[76] Inventor: Peter McDermott, 79 Thurleigh Road, London SW12, England

[21] Appl. No.: 946,360

[22] Filed: Dec. 24, 1986

[51] Int. Cl.[5] ..... B08B 3/02

[52] U.S. Cl. ..... 134/23; 134/22.18; 134/32; 134/33; 134/37; 134/40

[58] Field of Search ..... 134/22.18, 23, 32, 33, 134/37, 40; 60/39.33, 39.53; 415/117

[56] References Cited

U.S. PATENT DOCUMENTS

| | | | |
|---|---|---|---|
| 2,689,456 | 9/1954 | White | 60/39.33 X |
| 2,874,537 | 2/1959 | Scarborough et al. | 60/39.53 X |
| 2,974,482 | 3/1961 | Kelley | 60/39.53 X |
| 3,623,668 | 11/1971 | Freid et al. | 60/39.53 X |
| 3,830,660 | 8/1974 | Ezell | 134/23 |
| 4,059,123 | 11/1977 | Bartos et al. | 60/39.33 X |
| 4,065,322 | 12/1977 | Langford | 134/7 |
| 4,196,020 | 4/1980 | Hornak et al. | 60/39.33 X |
| 4,281,511 | 8/1981 | Neale | 60/39.53 |
| 4,295,895 | 10/1981 | Kongshaug | 134/23 X |

*Primary Examiner*—Asok Pal

*Attorney, Agent, or Firm*—Weingram & Zall

[57] ABSTRACT

Cleaning solvent is sprayed about the periphery of the air intake of a gas turbine engine in that area of the intake where the air speed is turbulent and relatively slow. The pattern of spray is created by a plurality of nozzles uniformly spaced about the periphery of the air intake. The nozzles each have a spray pattern of a fan shape at an angle of 90° respecting the exit aperture of the nozzle. The spray cloud thus created in the area of low speed relatively turbulent air before the compressor of the engine creates a uniform intake of cleaning fluid into the engine when the engine is operated at or near full speed and at or near full load.

The 90° fan shape pattern at the nozzle aperture narrows to 60° when the engine reaches operating speed and load.

4 Claims, 3 Drawing Sheets

METHOD AND APPARATUS FOR CLEANING A GAS TURBINE ENGINE

BACKGROUND OF THE INVENTION

1. Field of the Invention

The present invention relates to the cleaning of gas turbine engines and specifically to a method and apparatus which can be employed to provide thorough cleaning of a compressor of a gas turbine engine while the engine is running at or near full engine speed and load.

2. Description of the Prior Art

U.S. Pat. No. 4,065,322 issued Dec. 27, 1977, to Langford, discloses a method of removing contaminants from a gas turbine engine, such as an aircraft gas turbine engine. The patent removes contaminants from vanes and blades associated with the compressor of an aircraft gas turbine engine of the high by-pass type. The patent notes that in service, the surfaces of the compressor blades and vanes become coated with contaminants of various types. Oil and dirt have been found to adhere to the blade and vane surfaces. Aluminum and other metal substances erode from other portions of the engine and are deposited on the blades and vanes. As discussed in the patent, while one can remove contaminants from the engine by disassembly, it is much more desirable to remove the contaminants while the engine is in use and without interfering with the structural and metallurgical integrity of other components of the engine.

The Langford patent notes that liquid solvents have been proposed to be ingested in the engine with the engine set at idle speeds. The patent states, however, that liquid solvents chemically attack not only the contaminants, but other portions of the engine which are made of the same material as the contaminants. The patent states that ingestion of liquid solvents into the engine is not proven to be an acceptable method of removing the contaminants. The patent also discusses the use of solid particle abrasives ingested into the engine at idle speeds, but notes that such methods have been unsatisfactory for a variety of reasons.

The method of the patent proposes to use abrasive particles of coke having a carbon content of at least 80% by weight and a volatile matter content of less than 6% by weight and entraining the abrasive particles in the fluid flow stream, and directing the fluid flow stream in impingement onto the contaminated surface.

U.S. Pat. No. 4,196,020 to Hornak et al., cleans a gas turbine engine while the engine is being cranked. The patent employs an apparatus consisting of a manifold assembly releasably connected to the leading edge of the engine, which assembly includes an array of spray nozzles. The spray nozzles are located at specific locations within the engine relative to radially extending struts and each nozzle has an elongated spray pattern, the longitudinal axis of which is generally perpendicular to a radius of the engine inlet. The patentees claim that the sprays eminating from the nozzle within the inlet achieve the desired overlapping wash spray and are effective to completely wash the entire length of the adjacent strut-structures disposed in the engine inlet. The fluid applied to the engine is described as being a cleaning fluid and a rinsing fluid or a preservative fluid.

SUMMARY OF THE INVENTION

The method and apparatus involve a series of nozzles arranged to create a cloud of cleaning fluid around the entire engine intake in the area of relatively low speed turbulent air in front of the engine. Specifically, a plurality of nozzles are positioned adjacent the lip of the bellmouth of the engine because in this area the air speed is quite low and therefore does not disturb the function of the nozzle apertures in properly dispersing the flow of fluid from the nozzle orifice into an approximate 90° dispersion across the face of the air being drawn into the compressor inlet/bellmouth.

In practice, the air begins to flow in a straight and laminar pattern and also begins to rapidly accelerate, just as it passes into the compressor bellmouth. The smooth and regular shape of the inside of the bellmouth creates this flow pattern as the large mass of turbulent air from the large volume, irregular shaped plenum is drawn through it by the suction effect of the operating compressor.

The present invention differs from the method and apparatus employed in the prior art discussed above in that first the present invention operates the engine at or near full operating speed and load, and secondly, the method and apparatus of the invention is employed such that a liquid cleansing solvent is sprayed in such a manner that the output of the nozzle positions a cloud of cleaning fluid at the area of relatively low speed turbulent air in front of the engine. The fact that the direction of the spray is essentially across the direction of relatively little air flow in the engine results in acceleration of the spray in the transitional area such that it will flow in laminar rapid movement into the engine, resulting in uniform cleaning of the compressor blades.

Spraying the cleaning material as contemplated by the prior art discussed above results in formation of the cleaning fluid in laminar sheets. These sheets of fluid tend to become centrifuged and the centrifuged fluid tends to be directed towards the outer or tip portions of the compressor such that the inner portions of the compressor are not cleaned.

A principal object of the present invention is the provision of a method and apparatus for uniformly cleaning the compressor of gas turbine engines. A further object of the present invention is the provision of a method and apparatus for the cleaning of gas turbine compressors when the engine is operating at or near full operating speed and load. A further object of the present invention is the provision of a method and apparatus for cleaning gas turbine compressors which employs the spraying of a cleaning fluid across the front of the engine into the area of relatively low speed turbulent air. A further object of the present invention is the provision of a method of cleaning a gas turbine compressor which employs a cleaning fluid sprayed in front of the engine inlet.

A further object of the present invention is to clean a compressor with an apparatus employing a series of nozzles whose spray pattern effect is an approximately 90° fan spray with no relative air flow and which reduces to approximately 60° when the engine is running, such that a continuous covering of cleaning fluid covers the surface area in front of the engine.

A further object of the present invention is to provide a spray pattern of the cleaning fluid around the inlet of an engine to allow for a squeezing effect by the fan of the engine reducing the nozzles' spray pattern to an angle of 60° when the engine is running. A further object of the present invention is to provide a spray cleaning method and apparatus such that the spray occurs in the zone of transition from a turbulent to an accelerating laminar flow.

BRIEF DESCRIPTION OF THE DRAWINGS

These as well as further objects and advantages of the present invention will become apparent to those skilled in the art from a review of the following detailed specification, reference being made to the accompanying drawings in which.

DESCRIPTION OF THE PREFERRED EMBODIMENT

Figure 1:
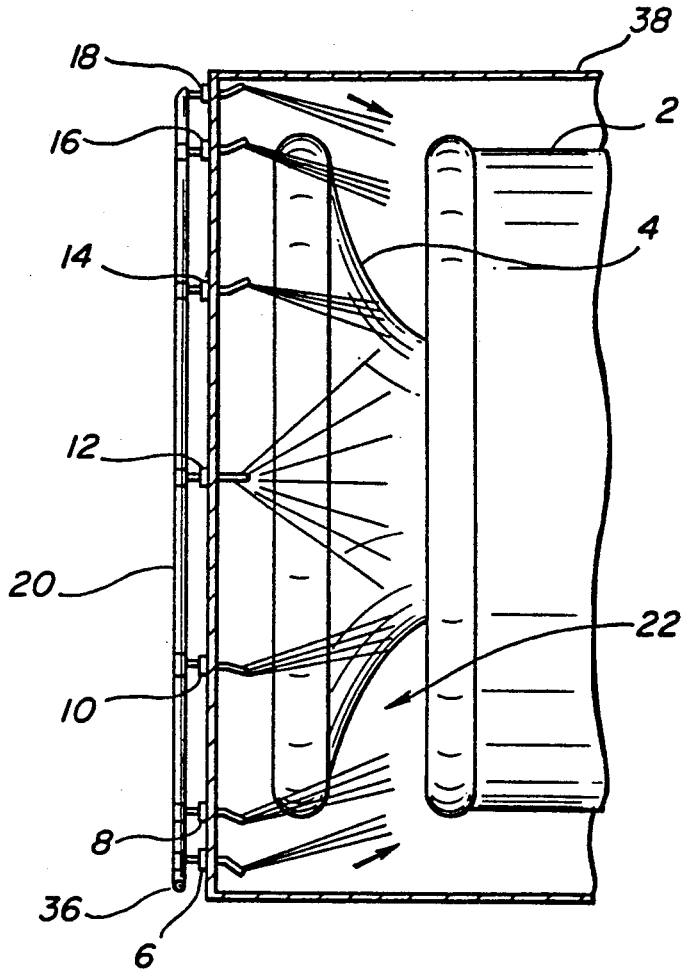
FIG. 1 is a diagramatic side view of a gas turbine engine's mouth with the spray apparatus of the present invention mounted thereon.

In FIG. 1, the bell-mouth portion of the gas turbine engine is shown having a cylindrical hollow portion 2 and a curved air-flow directional portion 4 mounted therein as is well-known in the art of gas turbine engines. Mounted about the periphery of the bell-mouth of the engine is an apparatus which consists of twelve nozzles mounted at a 30° pitch. The nozzles are mounted such that the spray pattern thereof is set to occur in a zone, 22, between the cylindrical portion 2 and the tapered air-flow portion for the gas turbine engine.

Figure 2:
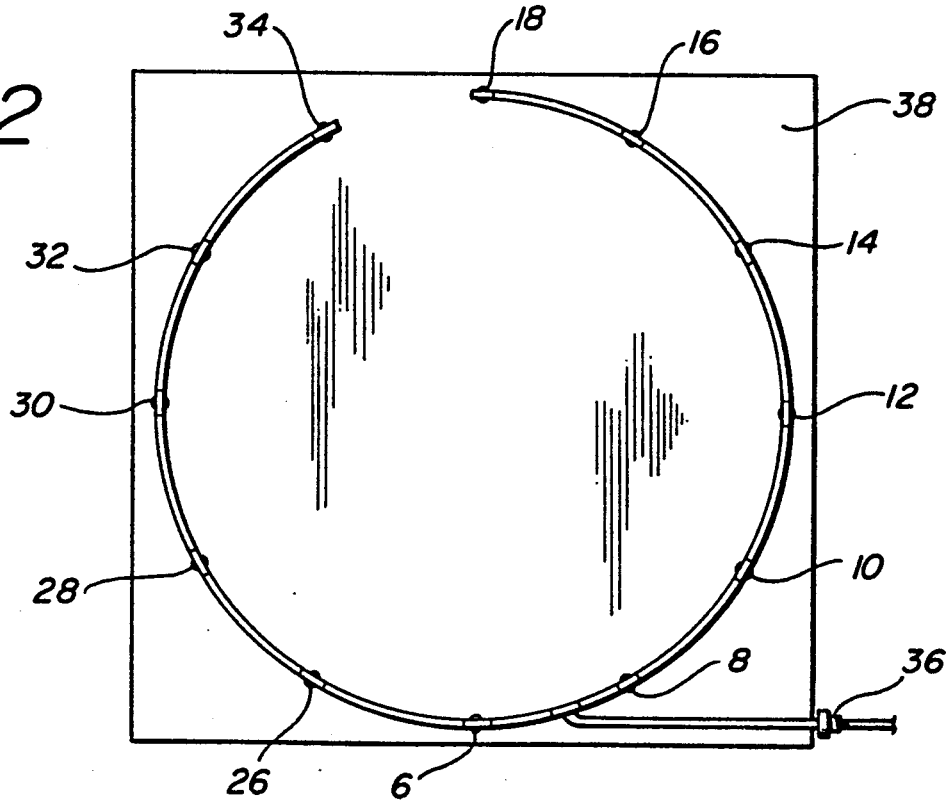
FIG. 2 is an end view of the spray apparatus of FIG. 1.

More particularly, shown in FIG. 1, a plurality of nozzles 6, 8, 10, 12, 14, 16 and 18 is shown all mounted on a common manifold ring 20. Twelve nozzles in total are employed and, as can be seen in FIG. 2, the remaining nozzles 26, 28, 30, 32 and 34 are mounted again at the 30° pitch along manifold ring 20. The solvent is fed to the manifold ring via a section of tubing 24 coupled between the manifold ring 20 and a flange connection 36. The entire manifold ring and nozzles are supported on a rectangular support frame 38, shown in FIGS. 1 and 2.

As will now be seen, fluid coupled via pipe 24 and flange 36 to manifold ring 20 will be caused to exit via each of the twelve spray nozzles 6, 8, 10, 12, 14, 16, 18, 26, 28, 30, 32 and 34 into the desired location 22 of the gas turbine engine shown in FIG. 1.

Figure 3:
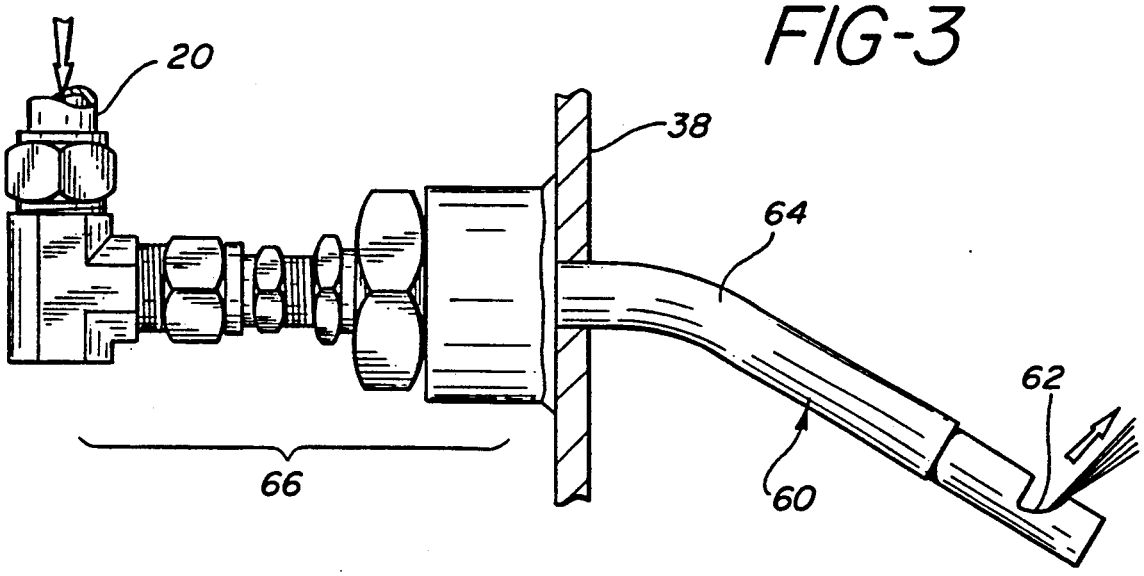
FIG. 3 is an enlarged view of one of the spray nozzles employed in the invention.

FIG. 3 shows the special nozzle utilized in the apparatus of the present invention. More specifically, in FIG. 3, the spray nozzle head portion 60 is coupled to the support wall portion 38 of the mounting frame 38 via suitable connections shown generally at 66. The details of this coupling arrangement are left to the skill in the art being simply that the spray head 60 be firmly affixed to the support frame 38. A suitable connection formed in the mounting plumbing 66 couples the spray head 60 to the manifold ring 20.

Figure 4:
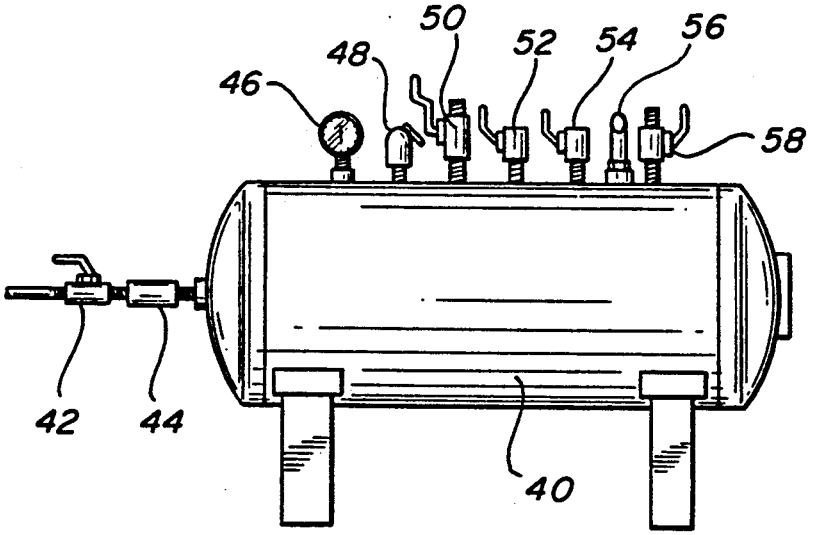
FIG. 4 is a diagramatic view of the fluid supply for the cleaning solvent utilized in the present invention.

As shown in FIG. 3, the spray head 60 has a bend portion 64. This bend occurs at an angle of 30° with respect to the horizontal. The exit aperture of the spray head 60, shown at 62, is notch-shaped such that the bulk of the spray produces a fan shaped pattern which is 90° with respect to the center of the apertures when no relative air-flow is present in the space 22 and approximately 60° when the engine is running and air-flow is present in space 22. FIG. 4 is a diagramatic view of the piping of a suitable supply system which supplies liquid solvent to the manifold ring 20. More specifically, FIG. 4 utilizes a tank 40 having outlet valve 42 formed therein. A filter 44 is coupled between the tank 40 and the outlet valve. A pressure gauge 46 is provided. The pressure relief valve 48 is also provided as a safety feature. Inlet valves 50 for chemicals and 52 for water are coupled at the top of the tank. Compressed air is connected to pressurize the tank via compressed air valve 54. A level gauge 56 is provided to sense the level of fluid in the tank. The tank can be vented via a vent 58.

As can now be seen, material is sprayed from the twelve nozzles into the area 22 of relatively low speed turbulent air in front of the engine. If a straight axial flow type of arrangement is present, the nozzle would be positioned behind the lip of the inlet of the engine so that the spray will occur across the direction of relative airflow.

In the embodiment described in connection with FIG. 1, the nozzles' output converges to form a cloud or fog-like effect in front of the air inlet. The spray pattern is designed to produce a complete curtain or cloud of atomized fluid at the inlet during the running mode. This allows for a "squeezing" effect on the fan of the nozzles to allow the nozzles to spray at an angle of 60° when the engine is running. The spray occurs in the zone of transition from turbulent to accelerating laminar flow.

Spraying across the relative airflow in the slow turbulent zone allows for the fog of fine droplets. Once the fog is accelerated in the transitional area, it flows in a laminar rapid movement into the engine.

As discussed above, if the cleaning material was sprayed directly in the engine, as is done in the prior art, the fluid would form laminar sheets, which tend to become centrifuged by the action of the blades and would be directed towards to the outer or tip portions of the compressor and would not clean the inner portions thereof. This result is avoided by injecting the spray across the airstream rather than parallel to the inlet airstream of the engine. The operation of the present apparatus is best conducted at full engine operating speed and maximum compressor speed. As the speed of the rotor increases, the pressure profile along the blade will stabilize and become uniform. It is at the maximum or near maximum engine speeds that the pressure profile along the blade becomes uniform and even. When an engine is cranked or running a low speeds, the pressure at the tip of the blades is near the optimum values. The remainder of the length of the inner portion of the blade is stalled and there is turbulent airflow over that surface which does not permit direct contact of the cleaning solvent with the contaminated surface. At the crank velocity, the inner surface of the blade is so slow that there is an unstable airflow which is unpredictable and therefore no cleaning solvent can reach the surfaces thereof. Thus, there is no cleaning inboard of the tips of the blades.

In practice, the pressure for injecting the liquid through the spray nozzles is approximately 80–100 p.s.i. The nozzle orifices are fixed at sizes ranging from 0.05 mm to 1.3 mm. The number of nozzles employed can be varied to provide the desired volume of liquid for the engine. Again, depending on the desired volume and number of nozzles, the radial displacement of each nozzle is determined, as the radial displacement is necessary for the spray pattern of approximately 60° to cover the entire surface of the inlet to create the fog pattern that will be drawn into the inlet.

Figure 5:
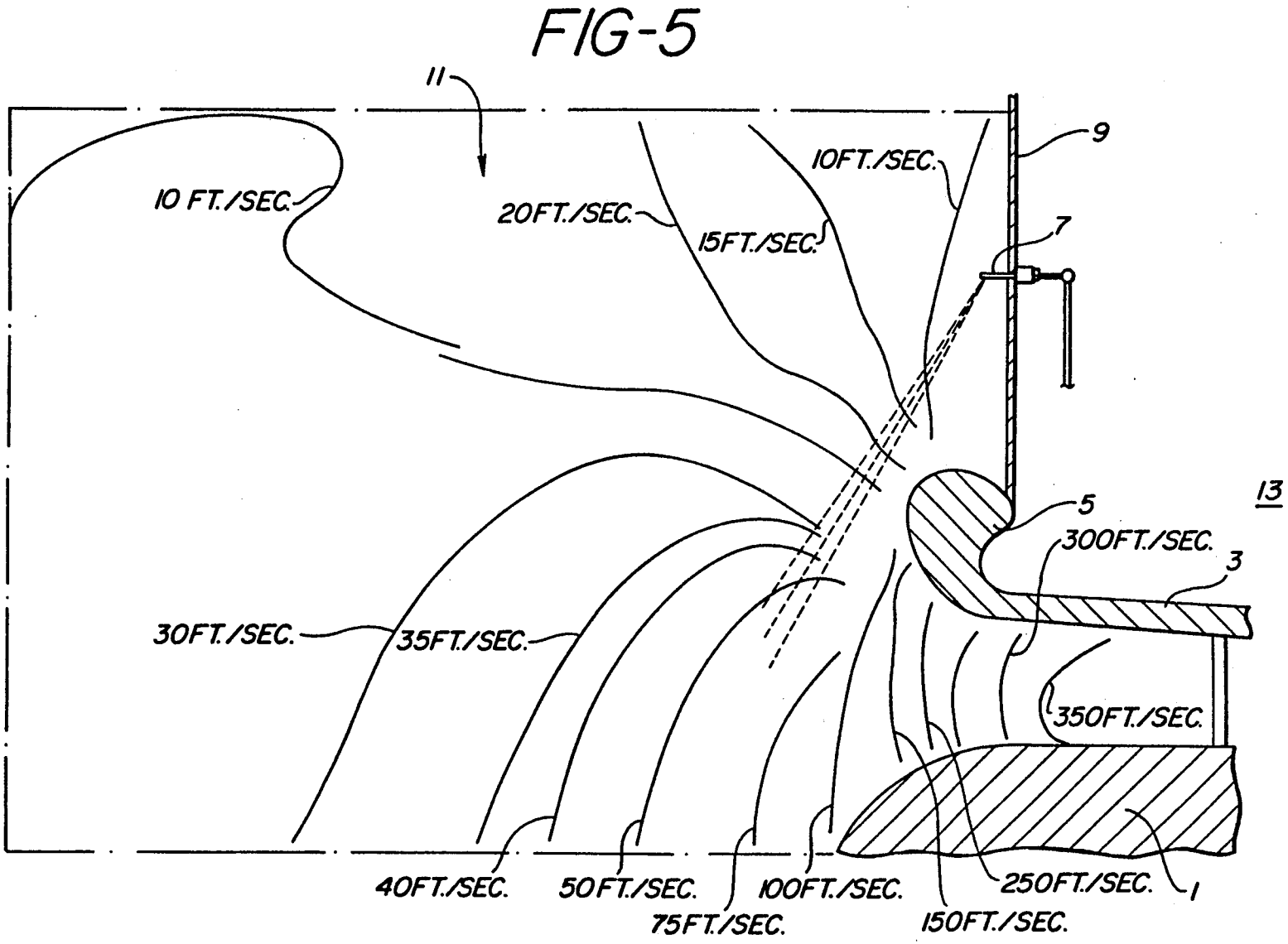
FIG. 5 is a diagramatic side view of an alternative mounting of the nozzles relative to the bellmouth showing a velocity profile of the air flow around the bellmouth.

FIG. 5 is an air velocity profile of the air speed at various points in the plenum 11 of a gas turbine engine. Specifically, the engine 13 has a center body portion 1, an exterior circumferential enclosure 3 and a bellmouth 5. A plurality of nozzles 7 are mounted to support 9 such that their spray pattern is into the area of relatively low speed air flow in plenum 11. The nozzles 7 may be of the type shown in FIG. 3 hereof. The array of nozzles 7 can thus be mounted about the bellmouth so that they are physically located opposite the mounting shown in FIG. 1 hereof.

As modifications to the foregoing may be made without departing from the spirit and scope of my invention, what is desired to be covered by United States Letters Patent is set forth in the appended claims.

I claim:

1. A method of cleaning a compressor of a gas turbine engine comprising the steps of:

operating the engine at or near full engine speed and load;

injecting cleaning solution into the air intake area of the engine at a position of said air intake where the intake air velocity is relatively low; and performing said injection at an entrance angle such that resultant air/cleaning solution mixture is injected in a pattern at an angle of approximately 60°.

2. The method of cleaning the compressor of a gas turbine engine operating at or near full engine speed and/or load comprising the steps of:

operating the compressor at or near full operating speed and/or load;

injecting a cleaning solution into an area in proximity to the air intake of the engine where the air flow is low and turbulent; and performing said injection step at an angle of injection such that the effect of the air flow into the engine creates an angle of injection of approximately 60°.

3. A method of cleaning the compressor of a gas turbine engine while the engine is running at or near full speed and at or near full load, the method comprising the steps of:

encircling the engine with a plurality of nozzles;

said nozzles having a spray pattern in still air of 90° with respect to the exit aperture of the nozzle;

said nozzles being arranged about the periphery of the air intake of the gas turbine engine such that the spray pattern thereof is dispersed into said air intake in an area of air flow which is relatively low and turbulent; and spraying a cleaning solvent through said nozzles.

4. A method of cleaning the compressor of a gas turbin engine while the engine is running at or near full speed and at or near full load, the method comprising the steps of:

forming a cloud of mist in front of the air intake of a gas turbine engine;

operating said engine at or near full speed and load; and causing said mist to be ingested into the compressor of said engine for thoroughly cleaning said compressor.

* * * * *